US005277418A

United States Patent [19]

Jones et al.

[11] Patent Number: 5,277,418

[45] Date of Patent: Jan. 11, 1994

[54] PRINTER PAPER PULLOUT APPARATUS

[75] Inventors: Gene D. Jones, Yacolt; Daniel R. Dwyer, Washougal; Allan G. Olson, Camas; Steve O. Rasmussen, Vancouver, all of Wash.

[73] Assignee: Hewlett-Packard Company, Palo Alto, Calif.

[21] Appl. No.: 954,766

[22] Filed: Sep. 29, 1992

[51] Int. Cl.[5] ..... B65H 1/22

[52] U.S. Cl. ..... 271/164; 271/162; 271/145

[58] Field of Search ..... 271/146, 162, 164, 171, 271/145

[56] References Cited

U.S. PATENT DOCUMENTS 4,915,370 4/1990 Himeji et al. ..... 271/162

FOREIGN PATENT DOCUMENTS 0244719 12/1985 Japan ..... 271/145
0008633 1/1991 Japan ..... 271/145
0008634 1/1991 Japan ..... 271/145

*Primary Examiner*—H. Grant Skaggs
*Assistant Examiner*—Carol Lynn Druzbick

[57] ABSTRACT

An improved printer paper pullout apparatus is described. In its preferred embodiment, the pullout apparatus includes a grasping mechanism, a capture mechanism and a securing mechanism. The grasping mechanism facilitates concurrent paper tray and paper stack movement from a printer feed zone. The securing mechanism ensures proper paper gripping before the paper tray can be released and extended from the printer feed zone. In addition, the grasping mechanism is shaped and positioned on the paper tray for ease of operator grip when manually extending the paper tray from the printer feed zone.

18 Claims, 3 Drawing Sheets

PRINTER PAPER PULLOUT APPARATUS

TECHNICAL FIELD

The present invention relates generally to an improved paper stack pullout apparatus. More particularly, the invention concerns a printer paper tray with a grasping mechanism to facilitate removal of a paper stack from a printer feed zone concurrently with extension of the paper tray.

BACKGROUND ART

Printer paper input trays were developed to support and align paper for feeding to a printer. Paper trays are positioned in a printer feed zone. In operation a paper stack is manually placed on the paper tray. The tray is then securely positioned adjacent the printer feed zone. With the tray in the secured position, the paper stack is adjacent paper picking mechanisms within the printer feed zone, the paper picking mechanisms feeding the top sheet of the paper stack to the printer.

The paper picking mechanisms operate by picking the top sheet from the stack and forcing the sheet into the printer. In some printers, prior to feed to the printer, the top sheet is partially removed from the stack by the paper picking mechanisms. Thus, when the printer finishes a print job, the top sheet of the paper stack in the input tray is slightly removed from the stack, and held by the paper picking mechanisms, ready for feed to the printer.

Between print jobs an operator may desire to extend the paper tray from the feed zone to add more paper to the paper tray, or to insert a different kind of paper. Conventionally, during extension of the paper tray frictional forces on the paper stack from the printer, including a guide rail, and frictional forces between the paper sheets themselves, caused sheets of the paper stack to be disturbed and repositioned out of a vertical trim and aligned stack. Additionally, in printers which pre-feed a top sheet through use of paper picking mechanisms, the top sheet often remained in the paper picking mechanisms upon extension of the paper tray. These problems required an operator to manually pull the top sheet out separately and realign the paper stack after extension of the paper tray, resulting in wasted operator time. In addition, manual pulling of paper from the paper picking mechanisms led to wasted paper because such manual pulling may bend and crease the paper, rendering the paper unusable.

DISCLOSURE OF THE INVENTION

The preferred embodiment of the invention represents an improved system for concurrent paper stack and paper tray removal from the printer feed zone. The invented printer paper pullout apparatus employs a gripping or grasping mechanism positioned on a paper tray to grip or pinchedly capture a paper stack, including the top sheet, to facilicate complete removal of paper from the printer feed zone concurrently with extension of the paper tray. In the preferred embodiment, the gripping mechanism includes a securing mechanism to ensure proper paper gripping before the paper tray can be released and extended from the printer feed zone. Ideally, the gripping mechanism is shaped and positioned on the paper tray for ease of operator grip when manually extending the paper tray from the printer feed zone. Thus, the preferred embodiment requires an operator to extend the paper tray to align a new paper stack with the current paper stack to form a new unitary paper stack in the paper tray for feed to the printer. In addition, in the preferred embodiment the paper contacting surfaces of the gripping mechanism have cork surfaces to facilitate further paper gripping.

There are several advantages of the present invention. Use of the gripping mechanism reduces operator time because paper is not left in the feed zone after tray extension. Single sheet paper feed to the printer is facilitated because a vertically trimmed unitary paper stack is positioned adjacent the paper picking mechanisms after paper is added to the paper tray. In addition, paper is not bent or creased upon extension from the printer feed zone.

The preferred embodiment includes a paper tray for supporting and aligning a paper stack in a printer feed zone for feeding to the printer. The paper tray is extendable from the printer feed zone. Mounted on the paper tray is a gripping mechanism including two expanses. One expanse is positioned above the paper stack on a forward, or operator, end thereof. The other expanse is positioned below the paper stack on the forward end. The opposing expanses, collectively called a capture mechanism, normally are biased into an open position to permit a sheet within the paper stack to be picked for printing by the paper picking mechanisms. At least one of the expanses is movable relative to the other upon operation of the gripping mechanism so that the stack is pinchedly captured between the expanses and thereby moved concurrently with extension of the input tray. The expanses are biased, preferably by a spring, to automatically return to their normal position after the operator releases the gripping mechanisms.

The preferred embodiment also includes a securing mechanism, also called a tray release mechanism, which is attached to, and operable in common with, the gripping mechanism. The tray release mechanism includes a movable, preferably pivotal, member including a clasp for releasably engaging the printer housing to secure the paper tray adjacent the printer feed zone. The movable member is moved, preferably pivoted, into a release position by operation of the gripping mechanism to release the tray from engagement to the printer housing. The movable member is baised, preferably by a spring, automatically to return to the secured position after the operator releases the gripping mechanism and slides the paper tray into a predefined secured position adjacent the printer feed zone.

DETAILED DESCRIPTION OF THE PREFERRED EMBODIMENT AND BEST MODE OF CARRYING OUT THE INVENTION

Figure 1:
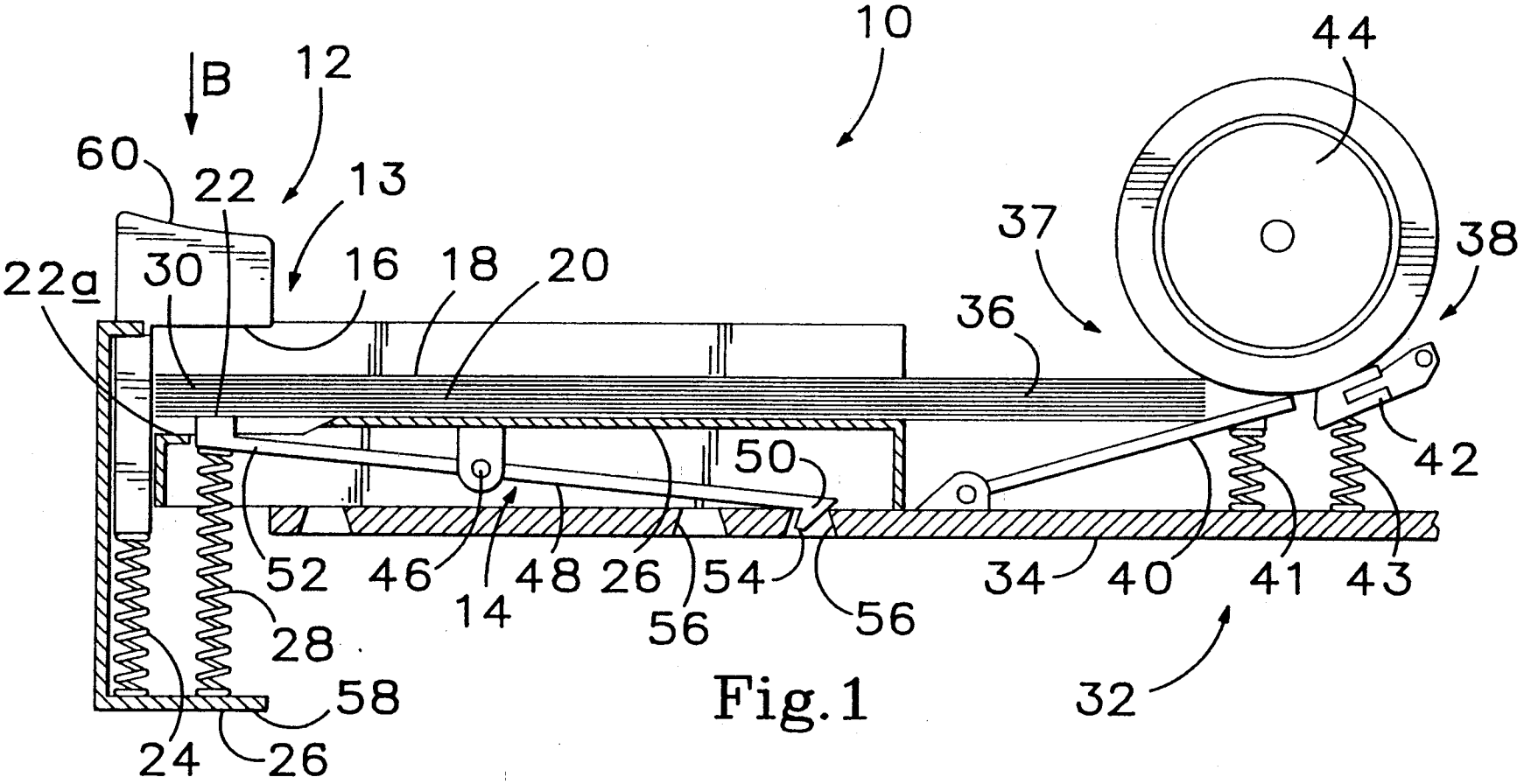
FIG. 1 is a simplified fragmentary side elevation showing in cross section the printer paper pullout apparatus made in accordance with the preferred embodiment of the invention.

FIG. 1 illustrates the preferred embodiment of the printer paper pullout apparatus 10. In the preferred embodiment, apparatus 10 includes a tray grasping mechanism 12, and a tray securing mechanism 14. Securing mechanism 14 is also called a tray release mechanism 14, and grasping mechanism 12 can also be thought of as a gripping mechanism 12.

Grasping mechanism 12 includes a capture mechanism 13. Capture mechanism 13 includes a first expanse 16 positioned above the a top sheet 18 of a paper stack 20 and having a top side 60. In the preferred embodiment, first expanse 16 is movable in direction B. Capture mechanism 13 also includes a second expanse 22, positioned below paper stack 20. Capture mechanism 13 can also include expanse **22*a*, positioned on a portion of paper tray 26, below paper stack 20. Expanse 22*a* can work in conjunction with expanse 22 to grip a paper stack 20**.

First expanse 16 is normally held in position above paper stack 20 by a first spring element 24, mounted on paper tray 26, also called printer paper feed tray 26 and having an underside 58. Expanse 22 is held in position, ideally directly below paper stack 20, by a second spring element 28. Spring element 28 is of a relatively high tensile strength to cooperate with expanse 16 in capturing a paper stack. In the preferred embodiment, opposing expanses 16 and 22, collectively form capture mechanism 13, and are positioned adjacent the operator end 30 of paper stack 20. In addition, in the preferred embodiment, expanses 16 and 22 are cork covered to facilitate paper gripping. Expanse **22*a*** can also be cork covered to further facilitate paper gripping.

Paper stack 20 is partially supported by paper tray 26. Paper tray 26 is releasably supported on a printer 32, more specifically, on the printer housing 34. Feed end 36 of paper stack 20, opposite operator end 30, is positioned in paper feed zone or position 37. Feed zone 37 includes paper picking mechanisms 38, attached to printer 32. In the preferred embodiment, paper picking mechanisms 38 include a spring-loaded pressure plate 40, a separator pad 42, and a pivotal, rotatable sheet positioning member including plural spaced drive rollers, such as drive roller 44. Pressure plate 40 is positioned adjacent drive roller 44 by a third spring element 41. Separator pad 42 is positioned adjacent drive roller 44 by a fourth spring element 43. Pressure plate 40 supports and provides a static upward force on feed end 36 of paper stack 20.

In the preferred embodiment, securing mechanism 14 is mounted on paper tray 26. Securing mechanism 14 includes a movable member 48 having a first end 50 and a second end 52, with member 48 being mounted for rotation by a pivot pin 46 defining a pivotal axis of member 48. First end 50 of pivotal member 48 includes a clasp 54 for protruding through recess 56 in printer housing 34, to secure paper tray 26 in a secured position against forward extension of the paper tray. A plurality of recesses 56 define multiple secured positions for paper tray 26 to accommodate varying paper stack lengths. Second end 52 of pivotal member 48 includes upwardly facing, bottom of paper stack-confronting expanse 22.

Figure 2:
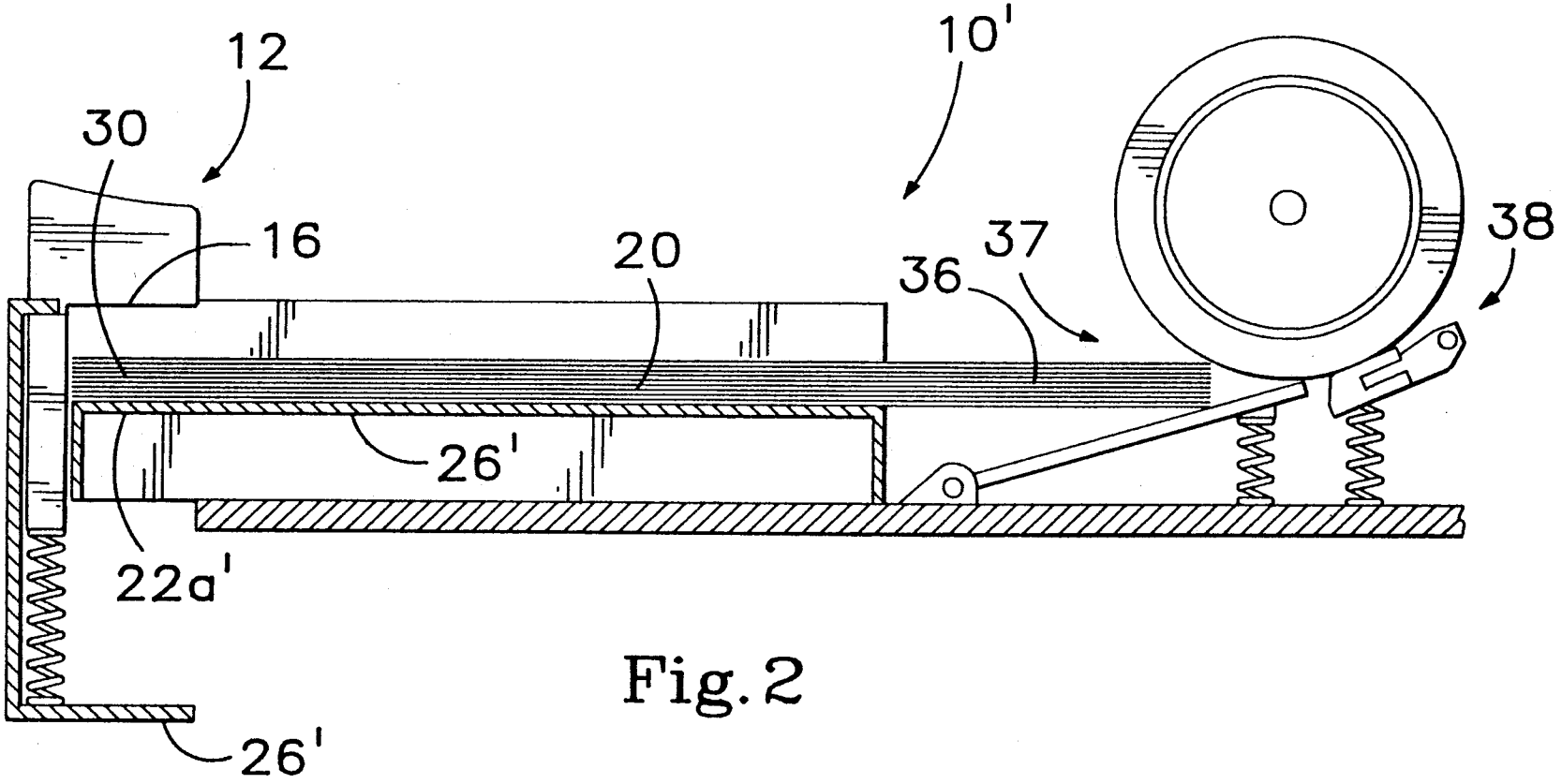
FIG. 2 is a proposed modification to the preferred embodiment shown in FIG. 1 that includes no securing mechanism.

FIG. 2 illustrates an apparatus 10', similar to apparatus 10 of FIG. 1, but representing an alternative embodiment 10' having no securing mechanism like mechanism 14 of FIG. 1. In FIG. 2, primed numerical designators (e.g. 10') represent structural elements that are similar to the elements of the preferred embodiment represented by unprimed numerical designators (e.g. 10). Apparatus 10' includes a grasping mechanism 12 which facilitates pinchedly securing a paper stack 20 between two opposing expanses 16 and **22*a'*, to ensure concurrent paper tray 26' and paper stack 20 extension or removal from printer feed zone 36. In apparatus 10' expanse 22*a'* is seen to form part of paper tray 26' at operator end 30**.

Alternative embodiment 10' has several advantages of the preferred embodiment but in addition, apparatus 10' had other characteristics. Apparatus 10' does not include securing mechanism 14 or second spring element 28 of apparatus 10 of FIG. 1. Due to the inclusion of fewer parts, the manufacturing cost and physical wear of apparatus 10' is less than that of apparatus 10. However, paper tray 26' of apparatus 10' can be extended from feed zone 37 without fully depressing first expanse 16. Thus, the gripping force at operator end 30 may be less than the frictional forces on the paper stack from a guide rail (undepicted) or from the paper picking mechanisms 38 at feed end 36. This can result in top sheet 18 being left in the printer feed zone 37 upon extension of paper tray 26'.

INDUSTRIAL APPLICABILITY

Figure 3:
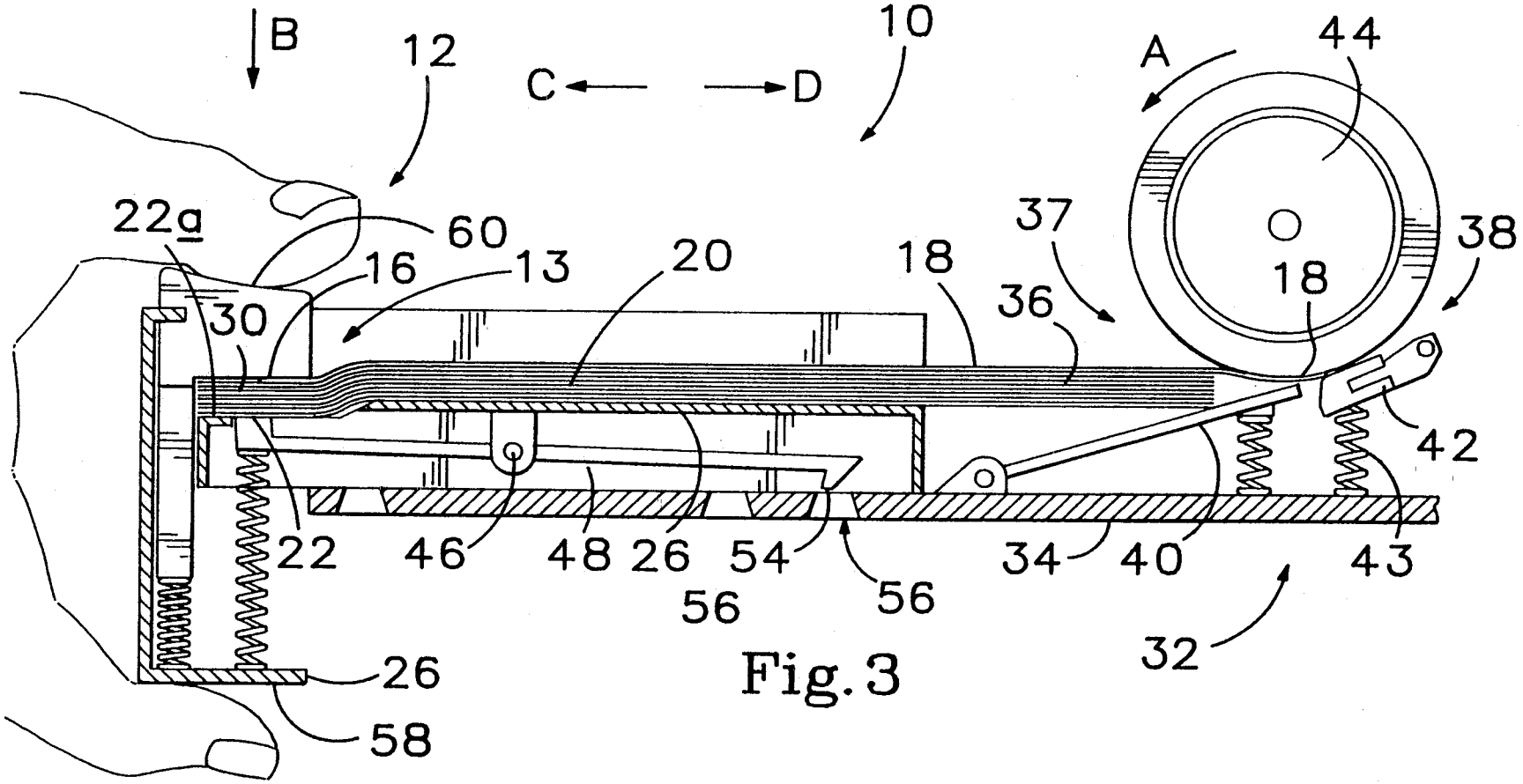
FIG. 3 is the apparatus of FIG. 1 shown with an operator moving the opposing expanses to pinchedly grip a paper stack.

FIG. 3 illustrates the preferred embodiment of apparatus 10 in operation. First, paper stack 20 is positioned on paper tray 26 with feed end 36 positioned adjacent paper picking mechanisms 38. Feed end 36 of paper stack 20 is supported on spring-loaded pressure plate 40 which forces top sheet 18 against drive roller 44. Drive roller 44 turns in direction A, pulling top sheet 18 from paper stack 20. Separator pad 42 ensures that only top sheet 18 is pulled into the printer 32, avoiding multi-sheet feeding. In such printers, upon finishing a print job, drive roller 44 stops turning, leaving top sheet 18 slightly removed from paper stack 20 and positioned between drive roller 44 and separator pad 42.

Between print jobs, an operator may extend paper tray 26 from printer 32 to add more paper or to insert a different kind of paper. In the preferred embodiment, grasping mechanism 12 facilitates extension of paper stack 20, including top sheet 18, concurrently with paper tray 26.

Grasping mechanism 12 is operable in common with capture mechanism 13. In the preferred embodiment, grasping mechanism 12 is also operable in common with tray release mechanism 14. By operable in common with we mean that the operator need only use one hand to grip a paper stack 20 in a paper tray 26, release the paper tray 26 from the printer housing 34, and then extend the paper tray 26 and the paper stack 20 concurrently from the feed zone 37. These three operations are efficiently accomplished in one comfortable hand movement, unavailable in the prior art.

As illustrated in FIG. 3, to operate grasping mechanism 12 in common with capture mechanism 13 and tray release mechanism 14, an operator grasps the topside 60 of first expanse 16 with the thumb and grasps the underside 58 of paper tray 26 with the fingers of the same hand. In the preferred embodiment, top side 60 is shaped to facilitate ease of grip, also called manual purchase, by the operator's thumb thereon. Downward manual gripping on top side 60 forces first expanse 16 in direction B which results in a force on expanse 22. Incident to this motion paper stack 20 is beneficially pinchedly captured, or gripped, between opposing expanses 16 and 22. In addition, depression of top side 60 in direction B moves second expanse 22 generally in direction B and thereby pivots movable member 48 about pivot axis 46, raising clasp 54 out of recess 56 in printer chassis 34. Second spring 28, which biases expanse 22, is of relatively high tensile strength to facilitate gripping of paper stack 20 between expanses 16 and 22.

As appreciated by those skilled in the art, one or both of expanses 16 or 22 can be moved during operation to effect pinching of the paper stack. In addition, the expanses can be positioned at various locations on the paper tray for various paper feed arrangements.

Further explaining the cooperable relationship of the structural elements, upon release of clasp 54 from recess 56 the operator extends or removes paper tray 26 away from feed zone 37 in direction C. Paper stack 20, including top sheet 18, is securely gripped by capture mechanism 13, as shown, between first expanse 16 and second expanse 22, and is thereby concurrently extended from feed zone 37 along with paper tray 26. Thus, the gripping force exerted on top sheet 18 at operator end 30 by expanses 16 and 22 overcomes the force exerted on feed end 36 by drive roller 44 and separator pad 42. Further, whether or not top sheet 18 is pre-fed between roller 44 and pad 42, the vertical alignment of all sheets in the stack is maintained during extension of the tray 26 for extension of both as a unit from the printer 32.

Upon placing additional paper or paper of a different kind in paper tray 26, the operator slides paper tray 26 along printer housing 34 in direction D toward feed zone 37 until clasp 54 engages recess 56. Such engagement secures paper tray 26 in the secured position with top sheet 18 positioned adjacent paper picking mechanisms 38. A plurality of recesses 56 are located in printer chassis 34 to permit tray 26 to be variously secured relative to feed zone 37 to accommodate varying paper stack lengths such as legal or letter size.

Another way of describing apparatus 10 is in terms of a gripping mechanism 12 which facilitates concurrent paper gripping and extension of paper tray 26 with paper stack 20 therein. Gripping mechanism 12 includes expanse 16 and second expanse 22. In operation, expanses 16 and 22 grip the paper stack 20 and facilitate extension of paper tray 26 and paper stack 20 as a unit. Gripping mechanism 12 includes top side 60 of expanse 16, which facilitates extension of paper tray 26. Thus, gripping mechanism 12 is cooperable with paper stack 20 to achieve extension of tray 26 and gripping of paper stack 20 in one efficient, comfortable hand movement.

In yet another description, shown in FIG. 2, grasping mechanism 12 is operable in common with capture mechanism 13, which includes expanses 16 and 22*a*'. Expanses 16 and 22*a*' facilitate grasping of paper stack 20 in paper tray 26 during extension of the latter from feed zone 37. Such concurrent extension and paper grasping is unavailable in the prior art.

Thus, the preferred embodiment of the present invention facilitates paper gripping, tray releasing, and tray extension operations in one efficient, comfortable movement, accomplished with a single hand of an operator.

To produce these objects and advantages of the present invention and alternative embodiments, the structural elements can be formed through an injection molding process utilizing a lightweight, stiff, but not rigid, material such as plastic. As described herein, the force mechanisms can be manufactured of metal or any such material which achieves the desired results.

While the present invention has been shown and described with reference to the foregoing operational principles and preferred and proposed alternative embodiments, it will be apparent to those skilled in the art that the proposed alternative and other changes in form and detail may be made therein without departing from the spirit and scope of the invention as defined in the appended claims.

We claim:

1. In a printer paper feed tray for supporting a paper stack, sheets of wich are to be picked for printing, wherein the printer has a housing and the tray is at least partway removable from the printer for paper stack handling, the improvement comprising:

a manually operable and releasable grasping mechanism connected with the tray and a tray release mechanism structurally connected with said grasping mechanism, said grasping mechanism providing manual purchase to facilitate extension of the tray from the printer by actuating said tray release mechanism, said grasping mechanism including a paper stack capture mechanism being operable in common with said grasping mechanism to secure the paper stack in the tray during such removal of the latter.

2. The improvement of claim 1 in which the tray is releasable secured in a predefined paper sheet feed position within the printer, and wherein said grasping mechanism and said tray release mechanism are operable in common to release the tray for such removal.

3. The improvement of claim 1, wherein said capture mechanism includes two or more opposing expanses, one positioned generally above and one positioned generally below the paper stack, said expanses being positioned normally to permit a sheet within the paper stack to be picked for printing, at least one of said expanses being movable relative to the other upon operation of said grasping mechanism such that the paper stack is pinchedly captured between said expanses.

4. The improvement of claim 3 in which the tray is releasable secured in a predefined paper feed zone of the printer, and wherein said grasping mechanism and said tray release mechanism are operable in common to release the tray for such removal.

5. The improvement of claim 4, wherein said tray release mechanism includes a movable member including a clasp for releasably engaging the printer's housing to secure the tray in said predefined feed zone, said member being pivoted into a tray release position thereof by operation of said paper stack grasping mechanism.

6. The improvement of claim 5, wherein said movable expanse is biased to restore said expanse automatically to said normal position and wherein said movable member is biased to return automatically to engagement of the housing upon manual release of said grasping mechanism.

7. The improvement of claim 6, wherein said movable expanse and said movable member are biased by one or more spring elements.

8. Paper stack pullout apparatus for use in a printer, the apparatus comprising:

a paper tray for feeding sheets of a paper stack supported thereby into a printer having a printer housing, said tray being extendable from the printer;

a gripping mechanism connected with said tray and cooperable with the paper stack supported on said tray, said mechanism being manually operable to grip the paper stack and to facilitate extension of said tray and the paper stack supported thereby as a unit; and a tray release mechanism connected to said gripping mechanism to release the tray from a predefined sheet feed position within the printer thereby to release the tray for such extension.

9. The apparatus of claim 8, wherein said paper gripping mechanism includes two or more opposing expanses, one positioned generally above and one positioned generally below the paper stack, said expanses being positioned normally to permit a sheet within the paper stack to be picked for printing, one of said expanses being movable generally toward to the other upon operation of said gripping mechanism such that the paper stack is pinchedly captured between said expanses.

10. The apparatus of claim 9 wherein said tray release mechanism includes a movable member including a clasp for releasably engaging the printer's housing to secure the tray in said predefined feed zone, said member being pivoted into a tray release position thereof by operation of said gripping mechanism.

11. The apparatus of claim 10, wherein said movable expanse is biased to restore said expanse automatically to said normal position and wherein said movable member is biased to return automatically to engagement of the housing upon manual release of said gripping mechanism.

12. The apparatus of claim 11, wherein said movable expanse and said movable member are biased by at least one spring element.

13. A paper stack pullout apparatus to ensure complete paper removal from a printer paper feed zone, the apparatus comprising:

a paper tray for receiving a paper stack for feeding into a printer including a printer housing, said tray being extendable from the printer;

a gripping mechanism connected with said tray and positioned adjacent the paper stack in said try, said gripping mechanism being manually operable to grip the paper stack and to facilitate extension of said tray concurrently with the paper stack; and a tray securing mechanism structurally connected with said gripping mechanism, said securing mechanism including a member having a clasp for engaging the printer's housing, said member being movable with respect to said tray, said securing mechanism releasably securing a predefined position of said tray adjacent the printer, and said securing mechanism releasing said tray from the said predefined position when said gripping mechanism is manually operated.

14. The apparatus of claim 13, where in said paper gripping mechanism includes generally opposing expanses, at least one being positioned generally above and at least one being positioned generally below the paper stack, said expanses being positioned normally to permit a sheet within the paper stack to be picked for printing, one of said expanses being movable relative to the other upon operation of said gripping mechanism such that the paper stack is pinchedly captured between said expanses.

15. The apparatus of claim 14, wherein said movable expanse is biased to restore said expanse automatically to said normal position and wherein said movable member is biased to return automatically to engagement of the housing upon manual release of said gripping mechanism.

16. The apparatus of claim 15, wherein said movable expanse and said movable member are biased by one or more spring elements.

17. The apparatus of claim 16, wherein said movable expanse and said movable member are each biased by a corresponding spring element.

18. The apparatus of claim 16, wherein said gripping mechanism is shaped to facilitate ease of operator grip thereon during manual operation.

* * * * *